United States Patent [19]

Chen

[11] Patent Number: 4,613,380

[45] Date of Patent: Sep. 23, 1986

[54] METHOD FOR REMOVING LIPID DEPOSITS FROM CONTACT LENSES

[75] Inventor: Jie Chen, Midland, Mich.

[73] Assignee: Dow Corning Corporation, Midland, Mich.

[21] Appl. No.: 718,131

[22] Filed: Apr. 1, 1985

[51] Int. Cl.[4] ..... B08B 3/08; B08B 3/10

[52] U.S. Cl. ..... 134/30; 134/26; 134/42

[58] Field of Search ..... 134/2, 22.19, 26, 29, 134/30, 40, 42

[56] References Cited

U.S. PATENT DOCUMENTS

| | | | |
|---|---|---|---|
| 2,955,047 | 10/1960 | Terry | 106/3 |
| 2,993,866 | 7/1961 | Vaughn et al. | 252/171 |
| 3,249,550 | 5/1966 | Metters | 252/161 |
| 3,433,667 | 3/1969 | Gergle et al. | 117/161 |
| 4,048,122 | 9/1977 | Sibley et al. | 134/26 X |
| 4,065,324 | 12/1977 | Rankin | 134/26 X |
| 4,127,423 | 11/1978 | Rankin | 134/26 X |
| 4,306,990 | 12/1981 | Goodman et al. | 252/174.15 |
| 4,324,595 | 4/1982 | Kasprzak | 134/38 |
| 4,421,665 | 12/1983 | Lloyd et al. | 134/40 X |
| 4,501,682 | 2/1985 | Goodman et al. | 252/174.15 |

FOREIGN PATENT DOCUMENTS 1295611 11/1972 United Kingdom .

OTHER PUBLICATIONS

Data Sheet No. 22-069b, "Dow Corning® 200 Fluid", Dow Corning Corp., Midland, MI (Aug. 1974), 6 pages.

Data Sheet No. 22-904-82, "Dow Corning® 244 and 245, 344 and 345 Fluids; Dow Corning® 200 Fluid, 0.65 cs", Dow Corning Corp., Midland, Michigan, (1982), 6 pages.

Brochure No. 41-639, "Introducing Sight Savers® Aerosol Anti-Fog and Cleaner", Dow Corning Corp., Midland, Michigan, (1975), 1 page.

Advertisement "Safer and Better Work with Clear Goggles", Mfg. and Industr. Eng., Feb. 1950.

Advertisement for "Sight Savers® Cleaner" from National Safety News, Jul. 1968, (A-8201), Glasses Stay Extra Clean, Extra Clear, Hours Longer . . . , Dow Corning Corp., Midland, MI, pp. 26-27.

Ruben, M., "Soft Contact Lenses: Clinical and Applied Technology", John Wiley & Sons, N.Y., 1978, pp. 383-424.

*Primary Examiner*—Robert Yoncoskie

*Attorney, Agent, or Firm*—Richard E. Rakoczy

[57] ABSTRACT

This invention relates to a method for removing lipid deposits from contact lenses of a polymeric material, particularly contact lenses wherein at least a portion of the polymeric material is an organosilicon compound, by contacting the contact lens surfaces with certain volatile methylsiloxane fluids such as octamethylcyclotetrasiloxane and thereafter removing the fluid and the lipids removed from the contact lens. This method is especially useful for removing lipid deposits from silicone elastomer contact lenses.

24 Claims, No Drawings

METHOD FOR REMOVING LIPID DEPOSITS FROM CONTACT LENSES

BACKGROUND OF THE INVENTION

This invention relates to a method for removing deposits from contact lenses of a polymeric material, particularly deposits of lipids from contact lenses wherein at least a portion of the polymeric material is an organosilicon compound, by contacting the contact lens surfaces with certain volatile methylsiloxane fluids such as octamethylcyclotetrasiloxane and thereafter removing the fluid and the lipids from the contact lens.

During use, contact lenses are known to acquire deposits of proteins, lipids and inorganic salts from the tear fluid and secretions of the eye. A number of commercially available contact lens cleaning solutions and cleaning regimens are available to remove such deposits with varying degrees of success. To be useful, the polymeric material from which the contact lens is made must be sufficiently wettable by human tears to be worn on the eye. If these deposits are allowed to build up, the contact lens eventually loses its wettability, optical clarity, or physiological compatibility, thereby becoming a non-functional contact lens.

The formation of deposits on the exposed surfaces of polymeric contact lenses involves a complex interaction between polymeric contact lens material (having a particular surface energy), the wearer's tear liquid composition (unique to each person), the tear liquid surface tension, and the polymeric lens material/tear liquid interfacial forces. These variables interact to determine the nature of the tear liquid components which predominate as accumulated deposits on the lens surfaces. It can be generalized that "like materials have an affinity to be preferentially attracted to one another".

Organic polar polymeric materials tend to attract proteins and salts which can be removed by aqueous contact lens cleaners containing nonionic surfactants and in the case of protein deposits, protein-digesting enzymatic cleaners are available. Water absorbing, soft contact lenses which are generally copolymers of hydrophilic, aliphatically unsaturated, organic compounds such as 2-hydroxyethyl methacrylate or N-vinyl pyrrolidone with difunctional cross-linking compounds such as triethylene glycol diacrylate (e.g., see U.S. Pat. No. Re. 27,401 to Wichterle, et al., issued June 20, 1972) are more prone to attracting deposits of proteins and salts which are at least somewhat polar in nature and therefore associate with the polar radicals present in the polymeric contact lens material.

A problem occurs when lipid deposits are present on the contact lens surface because lipid deposits tend to be nonpolar and hydrophobic in nature. Nonionic surfactant type contact lens cleaners do not remove lipids as well as proteins and salts. Enzymatic cleaners do not, to any great extent, remove lipid deposits such as cholesterol esters and the various other sterol esters, wax esters, free acids and triglycerides known to be deposited on contact lenses. Peroxides and bleaches are not very effective and abrasive cleaners can alter the optical surface of the lens after a number of cleanings.

A number of contact lenses are made of low surface energy polymeric materials. A number of these materials are partially or totally composed of organosilicon compounds such as polyorganosiloxanes which improve the oxygen permeability of the contact lens. For the purposes of this invention, the term "low surface energy material" means a material having a surface energy of less than about 40 dynes/square centimeters in accordance with its art recognized meaning. The higher the surface energy, the more wettable the material is by polar liquids. Examples of contact lenses which are completely composed of polyorganosiloxanes are found in U.S. Pat. No. 3,228,741 to Becker (issued Jan. 11, 1966 ) and U.S. Pat. No. 4,198,131 to Birdsall, et al. (issued Apr. 15, 1980) and examples of contact lenses which are composed of a copoymer of at least one aliphatically unsaturated organic compound such as methyl methacrylate or 2-hydroxyethyl methacrylate and at least one aliphatically unsaturated organosilicon compound (i.e., compounds containing one or more silicon atoms per molecule) are found in U.S. Pat. Nos. 3,808,178 to Gaylord (issued Apr. 30, 1974); 4,153,641 to Deichert, et al.; 4,291,953 to Covington (issued Sept. 29, 1981); and 4,419,505 to Ratkowski, et al. (issued Dec. 6, 1983).

Lipid deposits on low surface energy polymers, particularly the silicone-containing polymeric materials, are especially troublesome because hydrocarbon radicals such as methyl and phenyl radicals attached to silicon atoms are hydrophobic and tend to attract nonpolar lipids. In the case of silicone elastomer contact lenses of the Becker type above which have been surface-treated by the plasma treatment process described in U.S. Pat. No. 3,925,178 to Gesser, et al. (issued Dec. 9, 1975) to render the contact lens hydrophilic, only the surface is hydrophilic (i.e., wettable by tear fluid). The underlying subssantially polydimethylsiloxane elastomer core is very hydrophobic and lipids tend to not only attach to the surface, but also tend to be absorbed into the hydrophobic core. This absorption further complicates the removal of these deposits and may induce further accumulation of lipid deposits which are not adequately removed by currently available cleaning solutions and techniques and thereby shortening the useful life of such contact lenses. Use of abrasive cleaners or vigorous rubbing could remove the thin hydrophilic surface on such lenses and thereby expose the untreated underlying elastomer and render the lens surfaces hydrophobic (i.e., non-wettable by tear fluid) and nonusable.

There is a need for a method of cleaning lipid deposits from contact lenses, particularly those made of organosilicon compound-containing polymeric materials, which removes lipid deposits present on the lens surfaces and, preferably, within the material itself without permanently affecting the physical and optical properties (including color if tinted) of the contact lens and without causing the contact lens surfaces to lose their wettability to any significant degree. The cleaning medium used should also be substantially non-irritating to the eye and is sufficiently volatile to enable the medium to be removed from the contact lens along with the lipid deposits.

As will be explained further, the object of the present invention is to satisfy the aforementioned needs through the use of a contact lens cleaning medium comprising a volatile methylsiloxane fluid selected from the group consisting of certain volatile cyclic polydimethylsiloxanes, linear polydimethylsiloxanes, and branched methylsiloxane fluids which are at least as volatile at room temperature as decamethylcyclopentasiloxane such as the presently preferred octamethylcyclotetrasiloxane. The contact lens is contacted with the medium for a sufficient amount of time to permit the lipid deposits present to be removed from the surface of the lens and then the medium and the deposits associated with it are removed from contact with the lens.

For example, a plasma surface-treated hydrophilic polydiorganosiloxane elastomer contact lens containing lipid deposits can be immersed in a container of neat octamethylcyclotetrasiloxane medium for up to 30 minutes to remove the lipid deposits. It is withdrawn from the medium and excess medium is removed by shaking the contact lens and/or by rinsing the surface of the contact lens with a biocompatible aqueous medium to remove at least a portion of the cleaning medium and the lipid deposits associated therewith. The biocompatible aqueous medium can be, for example, water or isotonic saline solution. The lens is then placed in floating contact with water to permit the remainder of the medium to leave the lens material. After the medium and deposits are removed, the contact lens remains hydrophilic.

In an alternative embodiment of the method of the present invention, the volatile methylsiloxane fluid is dispersed in an aqueous medium to form an emulsion in which the volatile methylsiloxane fluid is the dispersed phase and the emulsion is either rubbed on the surfaces of the contact lens or the lens is immersed in the emulsion medium to remove the surface lipid deposits. The emulsion medium is then removed as above.

It is thought to be novel that the aforementioned methylsiloxane fluids would be useful in cleaning a hydrophilic contact lens without rendering its surface hydrophobic since it is well known that contaminants can render the surface of such lenses non-wettable. It is well known to use higher molecular weight silicone fluids to render the surfaces of substrates such as glassware water-repellent and hydrophobic by using, for example, a polydimethylsiloxane fluid which is sufficiently nonvolatile to leave a fluid film on the surface of the substrate.

Dow Corning Corporation of Midland, Michigan formerly sold an eyeglass cleaning and polishing tissues and fluid which contained methylsiloxane fluids under the name SIGHT SAVERS ® Silicone Treated Tissues and Liquid for use in cleaning hard glass and plastic spectacle and safety goggle lenses to remove grease and grime (e.g., cutting oils), to prevent steam-up, and to clean and polish the lenses. Some of the advertisements refer to leaving a coating of silicone on the lens surfaces to provide extended protection. See British Patent No. 1,295,611 (published Nov. 8, 1972) to Dow Corning Corporation for silicone-treated cleaning tissues for eyeglasses which use a siloxane-glycol copolymer as the cleaning and antifogging agent while U.S. Pat. No. 3,433,667 to Gergle, et al. (issued Mar. 18, 1969) teaches a polishing cloth containing partially cured methylsiloxane fluids and discusses methylsiloxane fluid-treated polish cloths as part of the prior art.

U.S. Pat. No. 2,993,866 to Vaughn, et al. (issued July 25, 1961) describes an aerosol spectacle cleaner containing a volatile alcohol and a siloxane fluid wherein the siloxane fluid is said to cooperate with the alcohol in the cleaning operation, particularly to aid in dissolving organic soils such as fingerprints, "fatty exudations from the skin and hairs around the eyes," and the like from the spectacles. U.S. Pat. No. 2,955,047 to Terry (issued Oct. 4, 1960) teaches cleaning compositions which contain 0.1 to 5% of a polydimethylsiloxane oil which is said to leave a film on the surface being cleaned and is used to improve the cleaning properties of the compositions in terms of wipe-off, soil removal, and ease of cleaning. The low surface tension of the dimethylsiloxane oil is said to enhance the wetting, adherence and spread of the cleaning composition of glass, wood and metal. In each of the foregoing patents, the siloxane fluids used tended to be high enough in viscosity (generally greater than 10 centistokes at room temperature where viscosities were mentioned) that the fluids were relatively nonvolatile since this would be desirable where a lasting film of the material is to be left behind. See Dow Corning Corporation Data Sheet No. 22-0696 dated 8-74 entitled "DOW CORNING ® 200 FLUID" showing that above 10 centistokes in viscosity, only 10% or less by weight of the fluid is lost after 24 hours at 150° C. Use of such fluid to clean a contact lens would not be desirable in spite of the grease cutting ability of the siloxane fluids.

Kasprzak, in U.S. Pat. Ser. No. 670,195 filed on Nov. 13, 1984 which is assigned to Dow Corning Corporation, Midland, Mich., teaches the use of volatile polydiorganocyclosiloxanes to remove grease from fabrics, but this does not suggest contact lens cleaning use since maintaining the hydrophilicity of a fabric does not seem to be critical in that application whereas it is in a contact lens cleaning application. Dow Corning Data Sheet No. 22-904-82 teaches that hexamethyldisiloxane, and the cyclic polydimethylsiloxane fluids DOW CORNING ® 244 and 344 Fluids (octamethylcyclotetrasiloxane) and DOW CORNING ® 245 and 345 Fluids (decamethylcyclopentasiloxane) are useful in a number of cosmetic and personal care formulations, but does not suggest use of these fluids as a cleaner for wettable contact lenses. That Data Sheet does describe the fact that the fluids are compatible with various stearates and other cosmetic ingredients. U.S. Pat. No. 4,324,595 to Kasprzak (issued Apr. 13, 1982) teaching the use of volatile methylsiloxane fluids to remove tacky adhesives from the skin similarly fails to teach the method of the present invention.

DETAILED DESCRIPTION OF THE INVENTION

These and other objects and advantages of the present invention are accomplished by a method for removing lipid deposits from tear wettable contact lenses which comprise the steps of:

(A) contacting the surfaces of a contact lens of a polymeric material containing lipid deposits thereon with a cleaning medium comprising a volatile methylsiloxane fluid as the lipid removing agent for a sufficient amount of time to remove a significant portion of the lipid deposits associated with said lens, (B) removing said medium and the lipid deposits removed therewith from said contact lens, wherein the physical and optical properties of the contact lens material remain substantially unchanged after contact with and removal of the methylsiloxane fluid and the contact lens surfaces remain wettable by tears after the methylsiloxane fluid is removed from the contact lens.

Volatile methylsiloxane fluids which are operable in the method of this invention are those which are biocompatible, lipid solvents and are at least as volatile at 23°±2° C. as decamethylcyclopentasiloxane so that the fluid leaves substantially no residue in the polymeric lens material after the lens is removed from contact with the methylsiloxane fluid and prior to its being placed on the eye, and more preferably, within 8 hours after the lens is removed from contact with the methylsiloxane fluid. The lens may be heated in contact with water in a conventional contact lens aseptor unit or autoclaved to accelerate the removal of the methylsiloxane fluid from the polymeric lens material. Another key criterion is the need for the formerly tear wettable lens surfaces to retain their wettability after contact with the methylsiloxane fluid. This is a major feature of the use of the methylsiloxane fluids in the present invention. Although the lens material may become somewhat swollen with the methylsiloxane fluid, the lens material should at least substantially retain its original physical and optical properties (including its color if tinted) after the fluid is removed from the contact lens along with the lipid deposits removed by the fluid.

The term "methylsiloxane" is intended to mean a composition containing two or more silicon atoms, all of which are bonded by way of at least one oxygen atom to at least one other silicon atom, and at least one methyl radical, each silicon valence not satisfied by oxygen being satisfied by a methyl radical. Thus, a methylsiloxane consists of two or more of the siloxane units having the formulae $Me_3SiO_{\frac{1}{2}}$, $Me_2SiO_{2/2}$, $MeSiO_{3/2}$, and $SiO_{4/2}$, wherein Me denotes the methyl radical.

The presently preferred volatile methylsiloxane fluid for use in the method of the present invention is $(Me_2SiO)_4$ which is known as octamethylcyclotetrasiloxane. Another fluid which has been investigated, but requires further toxicological testing before human clinical use (as will be discussed later) is $Me_3SiOSiMe_3$ (i e., hexamethyldisiloxane). Other useful volatile fluids may be linear methylsiloxane fluids such as $Me_3SiOMe_2SiOSiMe_3$, and cyclic polydimethylsiloxanes such as $(Me_2SiO)_3$ or $(Me_2SiO)_5$. Mixtures of fluids may also be used to obtain fluids with various levels of volatility. For example, since $(Me_2SiO)_3$ is a waxy solid at room temperature (boiling point $=133°$ C.), it can be more useful to employ such a material as a mixture with other cyclic polydimethylsiloxane fluids rather than to use it by itself. As is well known, methylsiloxane fluids are manufactured by equilibration methods and a small amount of other methylsiloxane fluids are often present in fluids which consist essentially of one particular methylsiloxane such as octamethylcyclotetrasiloxane; this does not detract from the utility of the methylsiloxane fluid in the method of the present invention.

Methylsiloxane fluids are well known and many are commercially available. Their synthesis is well documented in the literature and needs no further elaboration here. Octamethylcyclotetrasiloxane and hexamethyldisiloxane find use in cosmetic and personal care formulations such as antiperspirants, deodorants, hair sprays, hair grooming aids, skin creams, lotions and other stick-type products. Thus, use of such fluids in contact with the body is well established.

Examples of polymeric contact lens materials which may be cleaned by the method of the present invention have been described above. In view of the particular problems with lipid deposits associated with contact lenses made of polymeric materials wherein at least a portion of the material is an organosilicon compound, these polymeric materials are preferred for use with the method of the present invention. Polyorganosiloxane elastomer contact lenses are especially preferred for use with this method because such materials not only contain surface lipid deposits after wear, but also absorb lipids into the underlying elastomer core.

As will be shown in the following Examples, it was found that silicone elastomer contact lenses were swollen by the application of neat octamethylcyclotetrasiloxane fluid and a large amount of lipid deposits were removed from the lens as measured by Fourier Transform Infrared Spectroscopic techniques. Thus, lenses which were almost unusable as a result of heavy accumulations of lipid deposits could be restored to usefulness by contact with the neat octamethylcyclotetrasiloxane fluid. One must match the type of polymeric lens material with both the volatile methylsiloxane fluid to be employed and the exposure time to the methylsiloxane fluid since the physical and optical properties of hard resinous lenses can be affected more by fluid absorption than the more resilient elastomeric lenses. As shown in the following Examples, octamethylcyclotetrasiloxane fluid was found to be useful with a variety of polymeric materials. Suitability of particular methylsiloxane fluid for use with a particular polymeric lens material can easily be determined by immersing lenses of the material in question in the neat methylsiloxane fluid selected for varying periods of time and measuring the effect on the physical and optical properties of the lens after the fluid has been removed from the lens material.

In carrying out the method of the present invention, it is preferred that the contact lens be immersed in a neat solution of the methylsiloxane fluid if the lens contains heavy accumulations of lipid deposits. Based on experience with silicone elastomer and silicone resin contact lenses, immersion in the neat methylsiloxane fluid for a period of from 1 minute to 30 minutes at room temperature ($23°\pm2°$ C.) was found to be adequate to remove substantially all of the lipid deposits present with less than 15 minutes being more preferred to minimize the effect of the methylsiloxane fluid on the lens after the immersion step is completed. Surprisingly, it was found that several different kinds of polymeric contact lenses could be immersed in octamethylcyclotetrasiloxane fluid for 16 hours and once the octamethylcyclotetrasiloxane fluid was removed, the contact lenses were found to return to their original state without significant physical changes being observed. For hard polymeric contact lens materials, the minimum immersion time needed to remove the lipid deposits is preferably employed, i.e., generally less than 5 minutes at room temperature.

Once heavy deposits have been removed, a short immersion time of less than 5 minutes can be used on a weekly or monthly basis to minimize accumulation of lipid deposits. Some wearers tend to deposit greater amounts of lipids on their contact lenses than others and the exact regimen to be used should be established with the needs of the individual wearer in mind.

When the lens, particularly the silicone elastomer contact lens, has been in contact with the cleaning medium containing the methylsiloxane fluid for a sufficient amount of time, the contact lens is removed from the medium and shaken to remove excess medium and/or rinsed with a biocompatible aqueous medium to remove at least a portion of the cleaning medium and the lipid deposits associated therewith. The biocompatible aqueous medium can be, for example, water or isotonic saline solution. Then the convex surface of the lens is floated (not immersed—to hasten evaporation of the hydrophobic methylsiloxane fluid) on the surface of a reservoir of distilled water (no water should be present on the concave surface) until the remaining methylsiloxane fluid volatilizes out of the lens and the lens returns to its wettable, original state. The lens is left floating on the surface of the water reservoir overnight at room temperature (23°±2° C.) and is then removed from the reservoir, again rinsed with distilled water and is autoclaved in distilled water or is placed in a standard contact lens aseptor unit in distilled water to remove any remaining traces of methylsiloxane fluid. Alternatively, evaporation of the methylsiloxane fluid could be hastened by placing the lens in a controlled humidity chamber so that the maximum surface area of the lens can be exposed. The lens should be sterilized to remove any traces of fluid before use.

In the case of silicone elastomeric lenses which have been swollen to a degree by contact with the methylsiloxane fluid-containing medium, it may be advantageous to gently squeeze the lens to remove some of the excess fluid and hasten the removal of the methylsiloxane fluid. Squeezing must be done carefully because the physical properties of the lens are degraded when the lens is swollen and more care is needed when they are in the swollen state to avoid tearing the lens. Squeezing seems to be of value primarily in cases where the lens has folded over on itself as a result of swelling and the surface area of the lens has thus been decreased and it is difficult to float the lens on the surface of the water.

Alternatively, the medium employed to remove lipids can be one wherein the methylsiloxane fluid is present in a compatible solvent which does not permanently affect the polymeric contact lens material or, more preferably, is dispersed in water or other aqueous medium. Thus, the cleaning medium can be an emulsion wherein the methylsiloxane fluid is dispersed in an aqueous medium according to conventional techniques such as through the use of a nonionic surfactant of the types commonly used in the manufacture of contact lens cleaners for silicone-containing contact lenses such as those described in U.S. Pat. No. 3,954,644 to Krezanoski (issued May 4, 1976). One example of such nonionic surfactants is the PLURONIC series of polyoxyalkylene glycol surfactants sold by BASF Wyandotte Corporation of Parsippany, New Jersey such as PLURONIC F-127 the use of which is described in the following Examples. The surfactant and any other ingredients present in the medium should be capable of being removed from the contact lens and should not permanently affect it. The aqueous medium in which the methylsiloxane fluid is dispersed can be distilled water or isotonic saline solution optionally including other conventional additives such as preservatives and possibly other active cleaning agents to remove salts and proteins which are not effectively removed by the methylsiloxane fluid. Techniques for making dispersions and emulsions of methylsiloxane fluids in aqueous media are well known.

An emulsion cleaning medium can be easier to use and to clean up, but is generally less effective than the neat methylsiloxane fluid. The emulsion can simply be wiped or rubbed on the lens surfaces, allowed to remain in contact with the lens surfaces for a few minutes, and then wiped or rinsed away along with the removed lipid and other surface deposits. The lens is then floated on top of the surface of a distilled water reservoir until the volatile methylsiloxane fluid evaporates from the lens as described above. The contact lens can also be immersed in the emulsion cleaning medium as described above (although longer periods of time may be needed for lenses having large amounts of deposits) until the deposits are removed and then the volatile methylsiloxane fluid is removed as described above.

It was found that the lipid-removing power of emulsion cleaning media using octamethylcyclotetrasiloxane as the lipid solvent decreased rapidly as the amount of lipid solvent was decreased. It appeared that use of less than 80% by weight of methylsiloxane fluid (octamethylcyclotetrasiloxane) based on the total volume of aqueous emulsion medium resulted in very small amounts of lipid being removed from the surfaces of the contact lenses tested. Use of at least about 80% methylpolysiloxane fluid in the aqueous medium (weight/volume) is preferred. From this data, it appears that emulsion cleaning media is used on a regular basis to keep the lipid deposit levels low so that a large amount of lipid deposits do not need to be removed. Use of neat methylpolysiloxane fluids appears to be most desirable for initial cleaning of contact lenses which contain relatively large levels of lipid deposits.

Having described the manner in which the method of the present invention may be carried out, the following Examples are now provided to better enable those skilled in the art to practice that method.

In the following Examples, the NRL Contact Angle Goniometer from Rame-Hart, Inc. of Mountain Lake, N.J. was used to measure the receding water-in-air contact angle of a drop of distilled water approximately 2 millimeters ("mm") in diameter placed on the surface of the contact lens to be measured using a conventional suction method. The contact angle measurements were made as rapidly as possible at ambient room temperature (about 23±2° C.) and humidity. Generally, most patients can wear contact lenses if the receding water-in-air contact angle is less than 50 degrees (the lower, the better).

The level of lipid deposits on the contact lens were measured using a Fourier transform infrared spectrophotometer ("FTIR") technique using a Nicolet 60SX FT-IR System made by Nicolet Instrument Corporation of Madison, Wis. using a 2 $cm^{-1}$ resolution and 32 scans during the measurements. The lens samples to be measured were blotted dry before being sandwiched between two pieces of potassium chloride prisms. Infrared spectra were obtained using the transmission mode and the sampling areas was approximately 1 square centimeter. For attenuation in the total reflection mode, a zinc selenide prism (50×10×3 mm) was used with a bevel angle of 45 degrees and the spectra were obtained using a Nicolet 20-DX instrument. A standard calibration curve was generated by coating different amounts of cholesterol oleate (12 milligrams/milliliter hexamethyldisiloxane) on new (never worn) silicone elastomer contact lenses substantially composed of a polydimethylsiloxane elastomer which had been surface treated via the aforementioned Gesser, et al. Patent process to render the lens surfaces wettable by human tears. The results showed a linear relationship between the peak ratio (ester peak at 1735 $cm^{-1}$ to siloxane overtone peak at 1954 $cm^{-1}$) and micrograms of cholesterol oleate in the 240 to 420 microgram concentration range ("FTIR Peak Ratio"). It had previously been found that such contact lens were generally unusable by most wearers due to cloudiness of vision when the lens contained at least 300 micrograms or more of complex lipid deposits as measured by this FTIR calibration curve method. This FTIR method was used to evaluate the level of lipid deposits on both human worn and cholesterol oleate coated silicone polymer lenses even though it was recognized that on human worn lenses, other lipids besides cholesterol oleate (e.g., diglycerides and triglycerides) were most likely present and the calibration curve would be affected by this. Since the method did focus on an ester radical, it was felt that the results reported in the following Examples were valid estimates of lipid deposits levels on a comparative basis when a control sample was used as described below.

In Examples where individual lenses were tested which had been worn by human patients or coated with cholesterol oleate as an "artificial lipid material", each lens was split in half; one half was left as it was obtained or was cleaned with one cleaning medium and the other half was cleaned with another cleaning medium to obtain a reasonably good comparison of cleaning effectiveness.

Visual comparisons of the contact lenses were made by photographing them through a NIKON optical microscope in the dark field mode at 200× or 300× magnification.

EXAMPLE 1

In this Example, various types of conventional contact lens cleaning solutions and other types of agents were evaluated as cleaning media for their effectiveness in removing lipid deposits from silicone elastomer lenses which had been worn by human patients using the FTIR Peak Ratio method. Each lens was considered to be substantially unusable due to the amount of deposits present on the lens. Four commercially obtained contact lens cleaning or storage solutions were evaluated: Cleaner 1—OPTI-CLEAN which is an aqueous abrasive contact lens cleaner containing surfactants sold by Alcon Laboratories, Inc. of Fort Worth, Tex.; Cleaner 2—The Boston Lens Cleaner which is an abrasive-type solution cleaner containing anionic and other surfactants sold by Polymer Technology Corporation of Wilmington, Mass.; Cleaner 3—MIRAFLOW which is an isopropyl alcohol containing aqueous surfactant-type cleaner sold by CooperVision, Inc. of Mountain View, Calif.; and Cleaner 4 SOFT MATE® Weekly Cleaner which is an aqueous sterile soft contact lens containing nonionic surfactants which is made by Barnes-Hind Pharmaceuticals, Inc. of Sunnyvale, Calif. A silicone surfactant which was a silicone/glycol compound sold under the name DOW CORNING® 190 Surfactant by Dow Corning Corporation of Midland, Mich. was also evaluated ("Surfactant 1"). Distilled water and ethanol at various dilutions with distilled water was also evaluated. The above were comparative examples. The method of the present invention was demonstrated using a volatile fluid which contained about 95 percent octamethylcyclotetrasiloxane and the remainder was composed of other volatile polydimethylsiloxanes ("Siloxane 1").

In this Example, one half of the contact lens used was left untouched ("control") and the FTIR Peak Ratio was measured. The second half was rubbed with the cleaning medium between the fingers for the number of cycles described in Table I. The lens was then rinsed with distilled water, blotted dry and the FTIR Peak Ratio of the second half was measured. The amount of lipid deposit on the lens is reported in Table I and was calculated using the aforementioned calibration curve. It was assumed that the Control lens contained substantially the same amount of lipid deposits as did the second half of the lens and therefore the amount of lipids calculated to be on the second half (after cleaning) was subtracted from the Control lens amount to arrive at the micrograms of lipid removed reported in Table I. In Table I, the Control lens is reported directly below the results obtained using the second half of the same lens. It is readily apparent that soaking the contact lens for 30 minutes at room temperature in the octamethylcyclotetrasiloxane fluid followed by rubbing with a tissue and distilled water for about 20 seconds and thereafter storage in a partially open container of distilled water (the lens being floated on the water's surface with the convex surface resting on the water's surface and with no water droplets present on the concave lens surface) for at least 8 hours (i.e., until the lens returned to its original, non-swollen dimensions) at room temperature resulted in the removal of a substantial portion of the deposits present on the lens compared with the other cleaning media tried. Unless otherwise stated, this preferred procedure for removing the methylsiloxane fluid and lipid deposits from the lens was used in all Examples where lenses were immersed in a methylsiloxane fluid.

Table II reports the results obtained when human worn silicone contact lenses of the above type were soaked in Cleaner 1, Cleaner 4 and Siloxane I for periods of 1, 5, 15 and 30 minutes and 16 hours at room temperature and thereafter the lenses were freed of each solution either by rinsing with distilled water according to the directions of the manufacturer or, in the case of Siloxane 1, as described above. It was found that 1 minute of exposure to Siloxane 1 removed a sufficiently large amount of lipid deposits to result in an FTIR Peak Ratio below the detectable range of the instrument while the other two media tried were not very effective in removing such deposits.

EXAMPLE 2

In this Example, the effect of 30 minutes of soaking at room temperature in Siloxane 1 on the receding water-in-air contact angle and the physical dimensions of two silicone elastomer contact lenses of the type used in Example 1 were evaluated. The contact lenses used in this Example had a diameter of 11.3 millimeters and a center thickness of 0.07 millimeters both before soaking for 30 minutes in Siloxane 1 and after being removed from the Siloxane 1 and freed of Siloxane 1 as described in Example 1.

One contact lens used was a new contact lens which had never been worn. The receding water-in-air contact angle before soaking in the Siloxane 1 was 16 degrees and after being treated with Siloxane 1 (and after being stored overnight at room temperature in distilled water), the receding water-in-air contact angle of the lens was 20 degrees, which is substantially unchanged and is well within the range which is considered to be wettable and useful. A second human worn lens was found to have a receding water-in-air contact angle of 27 degrees before soaking for 30 minutes in Siloxane 1 and after such treatment (and after being stored overnight at room temperature in distilled water), the receding water-in-air contact angle of the lens was 21 degrees indicating that its wettability was somewhat greater than its original value.

These results indicate that no gross changes in physical size or wettability occurred after the lenses had been exposed to Siloxane 1 and freed of Siloxane 1.

Table III describes the physical effect of Siloxane 1 on various types of contact lenses after they were soaked at room temperature in Siloxane 1 for periods of 1, 5 and 30 minutes and 16 hours (overnight) based upon a visual examination of the lenses immediately upon being removed from Siloxane 1. Four different types of contact lens materials in the shape of contact lenses were evaluated: hard 100% silicone resin contact lenses which had been surface-treated using the aforementioned Gesser, et al. Patent process to render the surfaces wettable by human tears; silicone elastomer contact lenses of the type described in Example 1; hard silicone/acrylate copolymer resin contact lenses which were copolymers of an organosilicon material and aliphatically unsaturated organic monomer which had been tinted blue by the manufacturer; and a water-absorbing hydrogel contact lens which was substantially composed of cross-linked 2-hydroxyethylmethacrylate.

As can be seen from Table III, Siloxane I had the greatest effect on the silicone elastomer and hydrogel contact lens materials. The effect on the hydrogel lens material was rapid and did not seem to change with time while the silicone elastomer material tended to increase in size with time. It was noted that the silicone resin lens became fragile after 16 hours of exposure to Siloxane 1. It was noted that all of the lenses returned to their original state without visually observable physical change after the Siloxane 1 fluid had evaporated from the lenses. None of the blue tint was observed to be leached from the silicone/acrylate copolymer contact lens.

As a comparison, lenses of the above type were also soaked in acetone as above to check the effect of this strong solvent on these contact lenses. Extraction of the blue tint from the silicone/acrylate resin lenses was observed after five minutes and the color was lost after 30 minutes of soaking in acetone. Generally, acetone affected the physical properties of the hydrogel (doubled in size after 30 minutes soaking time), 100% silicone resin (fragile after 30 minutes soaking time) and the silicone/acrylate copolymer resin contact lenses (became soft and larger in diameter after 30 minutes soaking time) to a greater extent with time than did the Siloxane 1 and did not appear to be absorbed by the silicone elastomer contact lens as much as was the Siloxane 1. All lenses did return to their original state without visually observable physical change after the acetone had evaporated from the lenses.

EXAMPLE 3

In this Example, nine volunteer patients were selected to participate in a three week study using Siloxane 1 as a contact lens cleaning medium. In anticipation of this study, previously human worn silicone elastomer contact lenses of the type described in Example 1 were cleaned five times with Cleaner 4, soaked in Siloxane 1 for 30 minutes at room temperature, heat disinfected in aqueous solution in a standard contact lens aseptor unit and stored in distilled water. This process was done for 1, 2, 3, 4 and 5 days. An untreated lens was also tested as follows using a standard toxicological test procedure: The lenses were evaluated for cytopathic effect by placing them in contact with a confluent monolayer of human embryonic cells. After incubation for 24 hours, the cytopathic effect on the cells was microscopically evaluated against both a positive and a negative control. No cytopathic effect was produced by any of the lenses. In view of these results, the following limited three week study was undertaken.

Five patients were classified as "foggers" whose lenses have been observed in the past to accumulate a substantial degree of deposits in relatively short periods of time while four other patients were "non-foggers". One person (a "fogger") dropped out of the study due to a lack of interest. The primary purpose of the study was to discover any ocular responses to the use of Siloxane 1 as a contact lens cleaning medium and to observe whether or not surface wettability of the lenses were maintained. New contact lenses were dispensed to each patient at the start of the study.

It was desired that the lenses be cleaned twice per week using the following regimen: Initially, the lenses were soaked in Siloxane 1 for 30 minutes at room temperature although this time period was decreased to 15 minutes over the course of the study. After soaking, the lenses were rinsed with distilled water and "squeezed" to help express the Siloxane 1. Next, the contact lens was floated, convex side down, on top of a reservoir of distilled water overnight at room temperature to promote further evaporation and escape of the Siloxane 1 from the contact lens. Finally, the lens was again rinsed and then autoclaved in distilled water. Patients were dispensed a spare pair of lenses to facilitate the necessary overnight evaporation of the Siloxane 1. Due to the required four visits to the Clinic per week to achieve this cleaning regimen, some patients were not able to incorporate this into their schedule. On the average, the contact lenses were cleaned five times in this three week period.

The following observations were made during the study: Two lenses ripped during the squeezing process. The tensile strength of the lens appeared to be significantly reduced while the lens was swollen with the Siloxane 1. However, it did not appear that squeezing or wringing out the lens improved the evaporation time of the Siloxane 1. If the lens was rinsed with distilled water and floated overnight, lens parameter recovery was usually complete even without the use of squeezing out excess Siloxane 1. Squeezing only appeared to be of value where the lenses were too gnarled to float on the water surface and in this case, the squeezing encouraged a more uniform shape which was easier to float. In three cases, the lenses failed to return to their original parameters. After recleaning and resoaking, the lenses did return to their intended shape. It was noted that if the lenses were not perfectly floated (no water could be present in the concave portion of the lens while floating), restoration of original parameters was not possible.

Soaking time in Siloxane 1 was decreased from 30 minutes to 15 minutes during the course of the study; no differences were noted in lens parameter recovery time. One patient reported excess flare with one of his lenses, but could have been due to a minor alteration in base curve or peripheral curve which caused the lens to ride somewhat more superiorly than normal. However, visual acuity and wettability remained unaltered and acceptable. Furthermore, lens surface wettability was not significantly reduced over the time period studied. No significant increase in tear film break-up-time was noted.

Visual acuity and ocular health remained intact throughout the study. No iris involvement was noted. There were two instances of excess burning when the cleaner study lenses were placed on the eyes. This subsided after rerinsing. No ocular insult resulted and the patients continued to wear their lenses successfully.

The contact lens cleaning method did not appear to have contributed any detrimental ocular effects in this short-term feasibility study and the lenses did remain clear, clean and wettable throughout the time period involved.

A single subject who had been having difficulty keeping his hard silicone/acrylate resin contact lenses of the type described in Example 2 free of deposits was placed on a cleaning regimen using Siloxane 1. He found that the use of Siloxane 1 was effective in keeping his lenses cleaner than he was able to accomplish using other commercially available contact lens cleaning media. This patient still found that he needed to use an organic surfactant type cleaner also to remove protein and salt deposits as part of his lens cleaning regimen since Siloxane 1 is not very effective at removing such deposits.

EXAMPLE 4

The effect of dilution on the cleaning effectiveness of Siloxane 1 on human worn silicone elastomer contact lenses of the type described in Example 1 was tested in this Example by using a conventional surfactant commonly used as an active cleaning agent in contact lens cleaning solutions to disperse Siloxane 1 in isotonic saline solution to form an emulsion. To prepare such emulsions, 10 parts (grams) of a polyoxyalkylene glycol block copolymer surfactant (PLURONIC® F127 from BASF Wyandotte Corporation of Parsipanny, N.J.) was placed in a graduated cylinder which was then filled with isotonic saline solution until the total volume of the solution volume was 100 milliliters. This solution was added to the amounts of Siloxane 1 on a weight to weight basis and dispersed together to form emulsion cleaning media as described in Table IV. These media were used to clean the silicone elastomer contact lenses by using 3 cycles of rubbing between the fingers and the results are reported in Table IV. The receding water-in-air contact angles are also reported.

The results show that the cleaning effectiveness of the Siloxane 1 to remove lipids falls off rather rapidly as the amount of Siloxane 1 is decreased. Below 80% Siloxane 1 content, little lipid is removed as measured by the FTIR Peak Ratio method. Note that the 0% Control which contained 10% (weight/volume) of block copolymer was not effective in removing a measurable amount of lipid deposit as determined by this method. Emulsions containing at least 80% Siloxane 1 do appear to be of value where the lenses do not contain the large amount of lipid deposits contained by the lenses tested. As a daily or weekly cleaner, such emulsions may be quite satisfactory for contact lenses which have small levels of lipids deposits. These emulsions could then be used to prevent the deposition of large deposits of lipids on the contact lens by removing small amounts each week. The emulsion cleaner may only be effective in removing surface deposits of lipids and may not have the penetrating power to remove lipids within the contact lens elastomer that the neat Siloxane 1 possesses.

EXAMPLE 5

In this Example, an attempt was made to evaluate the cleaning effectiveness of Siloxane 1 with other types of contact lenses using an optical microscope technique. Since lipid deposits are not readily visible to the eye, the surface of the lens was observed microscopically for deposits using one half of the lens as a control sample and the second half was cleaned with the cleaning medium being tested. A visual rating system was used to visually estimate the level of deposits remaining on the lens surface where T4=worst case, deposits are visible to naked eye when lens is wet with water; T3=dry lenses show deposits visible to naked eye although they are not visible when wet; T2=deposits not visible to naked eye on dry lens, but are visible under 200× magnification and T1=visually clean, no deposits visible under 200× magnification. A subjective numerical rating of cleanliness based on 10 being best (clean, no deposits) and 1 being cloudy and heavily coated with deposits, a nonusable lens. The visual results obtained for the 100% silicone resin lenses described in Example 2 for a 15 minute soaking time at room temperature in the following agents followed by a single rinse with distilled water were (the control immediately follows the lens half tested):

| Cleaning Medium | Visual Rating | Scale (1-10) |
|---|---|---|
| Siloxane 1 | T3 | 9 |
| Control | T2 | 3 |
| Cleaner 1 | T1 | 7 |
| Control | T2 | 4 |
| Cleaner 3 | T2 | 9 |
| Control | T2 | 3 |
| Cleaner 4 | T2 | 6 |
| Control | T2 | 3 |

All lenses appeared to be visually cleaned reasonably well by the cleaning media used. Due to interfering species present in the resin, the FTIR Peak Ratio method could not be used with this type of resin polymer.

Three separate silicone/acrylate copolymer lenses of the type described in Example 2 were cleaned using a 1 minute soak in the following cleaning media: Siloxane 1, Cleaner 3 and Cleaner 4. The control side and the cleaned side of each lens was visually observed to have a rating of T3. The FTIR Peak Ratio method could not be used here due to ester linkage absorptions due to the presence of acrylate ester radicals in the polymeric material.

Hydrogel lenses of the type described in Example 2 were obtained and coated with coatings of cholesterol oleate to simulate lipid deposits on the unworn contact lenses. The coated lenses were soaked in the following cleaners with the following results:

| Cleaning Medium | Visual Rating | Scale (1-10) |
|---|---|---|
| Siloxane 1 | T2 | 7 |
| Control | T3 | 3 |
| Cleaner 1 | T2 | 6 |
| Control | T3 | 2 |
| Cleaner 3 | T2 | 9 |
| Control | T3 | 1 |
| Cleaner 4 | T2 | 9 |
| Control | T4 | 1 |

As with the other lenses, the FTIR Peak Ratio test was not useful due to ester radical absorptions from the 2-hydroxyethyl methacrylate polymerization product. Each of the cleaning media visually appeared to be about equally effective in removing visually apparent deposits. The study does show that the Siloxane 1 did not appear to damage the lenses and was effective in removing visually apparent deposits.

EXAMPLE 6

Another compound studied for its possible utility as a contact lens lipid removing agent was hexamethyldisiloxane ("Siloxane 2"). This material was found to be noncytopathic in human foreskin cell cytotoxicity testing, but a range finding eye irritation study was found which suggested that Siloxane 2 produced a mild irritation response in the iris of the rabbit eye when injected into the conjunctival sac. As a result, this material needs further study and regulatory agency approval (as does any other material) before it is placed in commercial use involving contact with the body. In view of the volatility, use of adequate autoclaving or aseptor treatment should eliminate all traces of the material from the contact lenses and avoid any possible adverse effects.

To check the effect of Siloxane 2 on the physical properties of silicone elastomer lenses described in Example 1, new, unworn contact lenses were used. Before exposure to Siloxane 2, the receding water-in-air contact angle was 10°/6°, the power of the lens was measured to be −4.62 diopters, the diameter was 11.3 mm, center thickness was 0.07 mm and the base curve was 7.5 mm. 2–3 drops of Siloxane 2 was placed on the concave surface of the lens and after 3 seconds (the lens begins to swell), 5 drops of water was placed on the concave surface of the lens and the lens was rubbed between the fingers 20 times. This process was repeated another 2 times. The lens was then liberally rinsed with water, put into a vial of distilled water, and heat sterilized. The lens was allowed to remain in the distilled water overnight at room temperature before the properties of the lens were measured. The receding water-in-air contact angle was found to be 23°/25°, the power of the lens was measured to be −4.50 and the diameter, center thickness and base curve were unchanged. A human worn silicone elastomer lens having a receding water-in-air contact angle of 68°/70° was treated in the same manner as the new lens and the receding water-in-air contact angle was found to be 56°/55° which was an improvement.

Table V is like Table I and reports the results obtained using human worn silicone elastomer contact lenses of the type described in Example 1 with Siloxane 2 and several different types of contact lens cleaning media. Siloxane 2 was found to be very effective in removing lipid deposits from these lipid deposit containing lenses.

TABLE I

| MEDIUM | RUBBING CYCLES* | FTIR** PEAK RATIO | CALCULATED LIPID CONTENT (μg/LENS) | LIPID CONTENT μg REMOVED |
|---|---|---|---|---|
| Cleaner 1 | 20 | .612 | 272 | 16 |
| CONTROL | 0 | .755 | 288 | |
| Cleaner 2 | 20 | .55 | 265 | 27 |
| CONTROL | 0 | .8 | 292 | |
| Cleaner 3 | 20 | .4 | 247 | 0 |
| CONTROL | 0 | .4 | 247 | |
| Surfactant 1 | 3 | .4 | 248 | 9 |
| CONTROL | 0 | .48 | 257 | |
| Water*** | 1 | .88 | 303 | 0 |
| CONTROL | 0 | .88 | 303 | |
| Ethanol (25%)**** | 1 | 1.02 | 320 | −10 |
| CONTROL | 0 | 1.10 | 330 | |
| Ethanol (50%)**** | 1 | .84 | 288 | 0 |
| CONTROL | 0 | .84 | 288 | |
| Ethanol (100%) | 1 | .39 | 234 | −16 |
| CONTROL | 0 | .43 | 250 | |
| Siloxane 1 | 30 Min Soak | .13 | <60 | >220 |
| CONTROL | 0 | .75 | 283 | |

*1 CYCLE = 20 Rubs between the fingers
**FTIR PEAK RATIO (1735 $cm^{-1}$/1954 $cm^{-1}$)
***Distilled Water
****Remainder is distilled water.

TABLE II

| TREATMENT | FTIR PEAK RATIO BEFORE TREATMENT | FTIR PEAK RATIO AFTER TREATMENT | CALCULATED LIPID CONTENT BEFORE TREATMENT (μg/LENS) | CALCULATED LIPID CONTENT AFTER TREATMENT (μg/LENS) | DIFFERENCE |
|---|---|---|---|---|---|
| Cleaner 1; 1 MIN. SOAK | 1.00 | .48 | 318 | 257 | 61 |
| Cleaner 1; 5 MINS. SOAK | 1.06 | .63 | 327 | 274 | 53 |
| Cleaner 1; 15 MINS. SOAK | .49 | .37 | 258 | 250 | 8 |
| Cleaner 1; 16 HRS. SOAK | .54 | .33 | 264 | 240 | 24 |
| Cleaner 1; 30 MINS. SOAK | 1.15 | .74 | 335 | 290 | 45 |
| Cleaner 4; 1 MIN. SOAK | 1.17 | .92 | 338 | 307 | 31 |
| Cleaner 4; 5 MINS. SOAK | .86 | .79 | 302 | 293 | 9 |
| Cleaner 4; 15 MINS. SOAK | 1.03 | .79 | 326 | 293 | 33 |
| Cleaner 4; 16 HRS. SOAK | .78 | .78 | 291 | 291 | 0 |
| Cleaner 4; 30 MINS. SOAK | .96 | .78 | 313 | 292 | 21 |
| Siloxane 1; 1 MIN. SOAK | .92 | 0* | 307 | 0 | 307 |
| Siloxane 1; 5 MINS. SOAK | .86 | 0* | 301 | 0 | 301 |
| Siloxane 1; 15 MINS. SOAK | .53 | 0* | 262 | 0 | 262 |
| Siloxane 1; 16 HRS. SOAK | .72 | 0* | 284 | 0 | 284 |
| Siloxane 1; 30 MINS. SOAK | .53 | 0* | 263 | 0 | 263 |

*Below detectable range.

TABLE III

| TIME | TYPE | 100% SILICONE RESIN | SILICONE ELASTOMER | SILICONE/ACRYLATE COPOLYMER | WATER ABSORBING HYDROGEL |
|---|---|---|---|---|---|
| 1 MIN. | A | S | CURVED | WAVY | LITTLE RIPPLING |
| | B | S | S | S | ⅛ LARGER |
| | C | S | SOFT | S | SWELLING |
| 5 MIN. | A | S | WAVY | SMOOTH | LITTLE RIPPLING |
| | B | S | ¼ LARGER | S | ⅛ LARGER |
| | C | S | SOFT | S | SWELLING |
| 30 MIN. | A | S | SMOOTH | SMOOTH | LITTLE RIPPLING |
| | B | S | ⅓ LARGER | S | ⅛ LARGER |
| | C | SOFT | SOFT | S | SWELLING |
| 16 HRS. | A | S | SMOOTH | SMOOTH | LITTLE RIPPLING |
| | B | S | ⅓ LARGER | S | ⅛ LARGER |
| | C | FRAGILE | SOFT | S | SWELLING |

A = EDGE CONDITION
B = DIAMETER
C = FLEXIBILITY OR TEXTURE
S = SAME AS ORIGINAL SAMPLE

TABLE IV

| CLEANING MEDIUM | Receding Water-in-Air Contact Angles | FTIR PEAK RATIO | LIPID DEPOSITS (μg/lens) |
|---|---|---|---|
| (A) 100% SILOXANE 1 | 22 | 0 | 240 |
| CONTROL | 60 | .54 | |
| (B) 90% SILOXANE 1 | 60 | .269 | 40 |
| CONTROL | 49 | .361 | |
| (C) 80% SILOXANE 1 | 45 | .40 | 15 |
| CONTROL | 61 | .507 | |
| (D) 50% SILOXANE 1 | 60 | N.A.* | |
| CONTROL | 57 | N.A.* | |
| (E) 25% SILOXANE 1 | 55 | N.A.* | |
| CONTROL | 40 | N.A.* | |
| (F) 10% SILOXANE 1 | 42 | .435 | 0 |
| CONTROL | 40 | .424 | |
| (G) 0% SILOXANE 1 | 35 | .407 | 0 |
| CONTROL | 35 | .391 | |

*Not evaluated

TABLE V

| MEDIUM | RUBBING CYCLES* | FTIR PEAK RATIO** | CALCULATED LIPID CONTENT (μg/LENS) | μg LIPID REMOVED |
|---|---|---|---|---|
| CLEANER 1 | 20 | .612 | 272 | 16 |
| CONTROL | 0 | .755 | 288 | |
| CLEANER 2 | 20 | .55 | 265 | 27 |
| CONTROL | 0 | .8 | 292 | |
| CLEANER 3 | 20 | .4 | 247 | 0 |
| CONTROL | 0 | .4 | 247 | |
| CLEANER 4 | 3 | .4 | 248 | 9 |
| CONTROL | 0 | .48 | 257 | |
| SILOXANE 2 | 3 | .13 | 60 | 352 |
| CONTROL | 0 | 1.81 | 412 | |

*1 cycle - 20 rubs between the fingers
**FTIR PEAK RATIO (1735 $cm^{-1}$/1954 $cm^{-1}$)

That which is claimed is:

1. A method for removing lipid deposits from tear wettable contact lenses which comprises the steps of:
   (A) contacting the surfaces of a contact lens of a polymeric material containing lipid deposits thereon with a cleaning medium comprising a volatile, biocompatible methylsiloxane fluid as the lipid removing agent for a sufficient amount of time to remove a significant portion of the lipid deposits associated with said lens,
   (B) removing said medium and the lipid deposits removed therewith from said contact lens, wherein the physical and optical properties of the contact lens material remain substantially unchanged after contact with and removal of the methylsiloxane fluid and the contact lens surfaces remain wettable by tears after the methylsiloxane fluid is removed from the contact lens.

2. The method as claimed in claim 1 wherein said volatile methylsiloxane fluid consists essentially of octamethylcyclotetrasiloxane.

3. The method as claimed in claim 2 wherein said medium is an emulsion wherein said volatile methylsiloxane fluid is dispersed within an aqueous medium.

4. The method as claimed in claim 1 wherein said medium is an emulsion wherein said volatile methylsiloxane fluid is dispersed within an aqueous medium.

5. The method as claimed in claim 1 wherein at least a portion of said polymeric material is an organosilicon compound.

6. The method as claimed in claim 5 wherein said polymeric material is a polydiorganosiloxane elastomer.

7. The method as claimed in claim 5 wherein said polymeric material is a hydrophilic copolymer of at least one aliphatically unsaturated organic compound and an aliphatically unsaturated organosilicon compound.

8. The method as claimed in claim 1 wherein said polymeric material is a cross-linked hydrophilic copolymer of at least two aliphatically unsaturated organic compounds.

9. The method as claimed in claim 2 wherein at least a portion of said polymeric material is an organosilicon compound.

10. The method as claimed in claim 9 wherein said polymeric material is a polydiorganosiloxane elastomer.

11. The method as claimed in claim 9 wherein said polymeric material is a hydrophilic copolymer of at least one aliphatically unsaturated organic compound and an aliphatically unsaturated organosilicon compound.

12. The method as claimed in claim 2 wherein said polymeric material is a cross-linked hydrophilic copolymer of at least two aliphatically unsaturated organic compounds.

13. The method as claimed in claim 1 wherein said volatile methylsiloxane fluid contains at least three silicon atoms per molecule.

14. The method as claimed in claim 3 wherein the volatile methylsiloxane fluid comprises at least 80 weight percent of said emulsion.

15. The method as claimed in claim 1 wherein the cleaning medium consists essentially of a volatile methylsiloxane fluid.

16. The method as claimed in claim 15 wherein the methylsiloxane fluid consists essentially of octamethylcyclotetrasiloxane.

17. A method for removing lipid deposits from tear wettable contact lenses which comprises the steps of:

(A) contacting the surfaces of a contact lens of a polymeric material containing lipid deposits thereon with a cleaning medium comprising a volatile methylsiloxane fluid as the lipid removing agent for a sufficient amount of time to remove a significant portion of the lipid deposits associated with said lens, (B) rinsing the surfaces of said contact lens with a biocompatible aqueous medium to remove at least a portion of said medium and the lipid deposits associated therewith from the surface of the lens, and (C) floating the lens convex side down on the surface of a reservoir of an aqueous medium selected from the group consisting of water or isotonic saline solution for up to sixteen hours at room temperature to complete the removal of said cleaning medium from the lens, wherein the concave portion of the lens is kept free of water during this procedure, wherein the physical and optical properties of the contact lens material remain aubstantially unchanged after contact with and removal of the methylsiloxane fluid and the contact lens surfaces remain wettable by tears after the methylsiloxane fluid is removed from the contact lens.

18. The method as claimed in claim 17 wherein said volatile methylsiloxane fluid consists essentially of octamethylcyclotetrasiloxane and the biocompatible aqueous medium is selected from the group consisting of water and isotonic saline solution.

19. The method as claimed in claim 17 wherein said medium is an emulsion wherein said volatile methylsiloxane fluid is dispersed within an aqueous medium.

20. The method as claimed in claim 18 wherein said medium is an emulsion wherein said volatile methylsiloxane fluid is dispersed within an aqueous medium.

21. The method as claimed in claim 17 wherein the cleaning medium consists essentially of a volatile methylsiloxane fluid.

22. The method as claimed in claim 21 wherein the methylsiloxane fluid consists essentially of octamethylcyclotetrasiloxane.

23. The method as claimed in claim 17 wherein the method further includes the step (D) of heating said lens in water for a period of time which is sufficient to remove any remaining traces of said volatile methylsiloxane fluid from said contact lens.

24. The method as claimed in claim 18 wherein the method further includes the step (D) of heating said lens in water for a period of time which is sufficient to remove any remaining traces of said volatile methylsiloxane fluid from said contact lens.

* * * * *